US007793519B2

(12) United States Patent
Schecter

(10) Patent No.: US 7,793,519 B2
(45) Date of Patent: Sep. 14, 2010

(54) RETAINING PRONG AND SETTING

(76) Inventor: Joel Schecter, 42 Rodman Ave., Havertown, PA (US) 19083

( * ) Notice: Subject to any disclaimer, the term of this patent is extended or adjusted under 35 U.S.C. 154(b) by 723 days.

(21) Appl. No.: 11/638,679

(22) Filed: Dec. 13, 2006

(65) Prior Publication Data

US 2008/0141716 A1 Jun. 19, 2008

(51) Int. Cl.
*B23P 5/00* (2006.01)
*A44C 17/02* (2006.01)

(52) U.S. Cl. ..... 63/35; 29/10; 63/26; 63/33

(58) Field of Classification Search ..... None
See application file for complete search history.

(56) References Cited

U.S. PATENT DOCUMENTS 2,764,001 A 9/1956 Lutrario
5,800,574 A 9/1998 Ricci et al.
6,598,277 B1 * 7/2003 Schecter ..... 29/10
7,228,605 B1 * 6/2007 Morton ..... 29/10

* cited by examiner

*Primary Examiner*—Jack W. Lavinder
(74) *Attorney, Agent, or Firm*—Law Offices of John A. Parrish

(57) ABSTRACT

An improved prong for use in a retaining device such as a jewelry setting is disclosed. The prong includes a riser section, an engagement section and a lever section. The riser section may include one or more indents and a longitudinal groove to aid in engagement of an object such as a gemstone. The engagement section may include diverging tines configured to match the contour of a gemstone. The present invention also provides a jewelry setting which includes the prongs.

28 Claims, 3 Drawing Sheets

RETAINING PRONG AND SETTING

FIELD OF THE INVENTION

The disclosed technology relates to prongs for use in retaining devices such as jewelry settings, and to settings which incorporate prongs.

BACKGROUND OF THE INVENTION

A known method of securing gemstones in a jewelry setting is by use of notched prongs. In this method, a portion of the periphery of the stone is supported by the prongs to display the stone.

Prongs, when used in a jewelry setting, are deformed by tools such as pliers to engage the edge of a gemstone during the process of securing a gemstone in the setting. During this process, however, the tips of the prongs are deformed uncontrollably. As a result, the final configuration of the tips which engage the gemstone may differ significantly from their intended configuration. This can result in an insecure setting as well as an undesirable appearance of the setting. A need therefore exists for prongs which can be controllably deformed to retain the initial configuration of their tips to secure an object such as a gemstone in a jewelry setting.

SUMMARY OF THE INVENTION

The present invention provides an improved prong for use in retaining devices such as jewelry settings for retention of objects such as gemstones, especially gemstones which have angular tips or corners. The prong includes a riser section, a base section, an engagement section and a lever section. The riser section may include one or more indents and a longitudinal groove to aid the initial engagement of an object such as a gemstone. In one embodiment, the engagement section also includes diverging tines which form a V-notch. The tines may be configured to match the contour of an object such as a gemstone. The present invention also provides a jewelry setting which includes the prongs.

The prong may include a groove that extends over a portion of or the entire length of the riser section. The riser section may have an upward slope of angle Θ to the horizontal, wherein the angle Θ is about 5° to about 85°, preferably wherein the angle Θ is about 35° to about 65°, more preferably wherein the angle Θ is about 45°. The engagement section of the prong may be oriented to the riser section at angle β preferably where β=180°−Θ, generally at an angle β of about 130°−Θ to about 230°−Θ°. The lever section may be in linear alignment with the engagement section or oriented to the engagement section at an angle other than in linear alignment. The engagement section includes tines which diverge from each other to a form V-notch and the tines slope downward toward the rear of the engagement section at an angle of about 1° to about 89° to the horizontal, preferably at an angle of about 5° to about 35° to the horizontal, more preferably at an angle of about 5° to about 15° to the horizontal. The angular width of the V-notch may be about 1° to about 179°. The lever section and the engagement section may have the same or different configurations and the lever section may have a length of about 50% to about 150% of the length of the engagement section. The lever section also may have a width that is about 100% to about 150% of the width of the engagement section, and a thickness that is about 75% to about 150% of the thickness of the engagement section. A separating groove may be provided between the lever section and the engagement section. The invention further relates to a jewelry setting that includes the prong having any of the features described above.

The invention will now be described in further detail below by reference to the non-limiting drawings and detailed description.

DETAILED DESCRIPTION OF THE INVENTION

Figure 1:
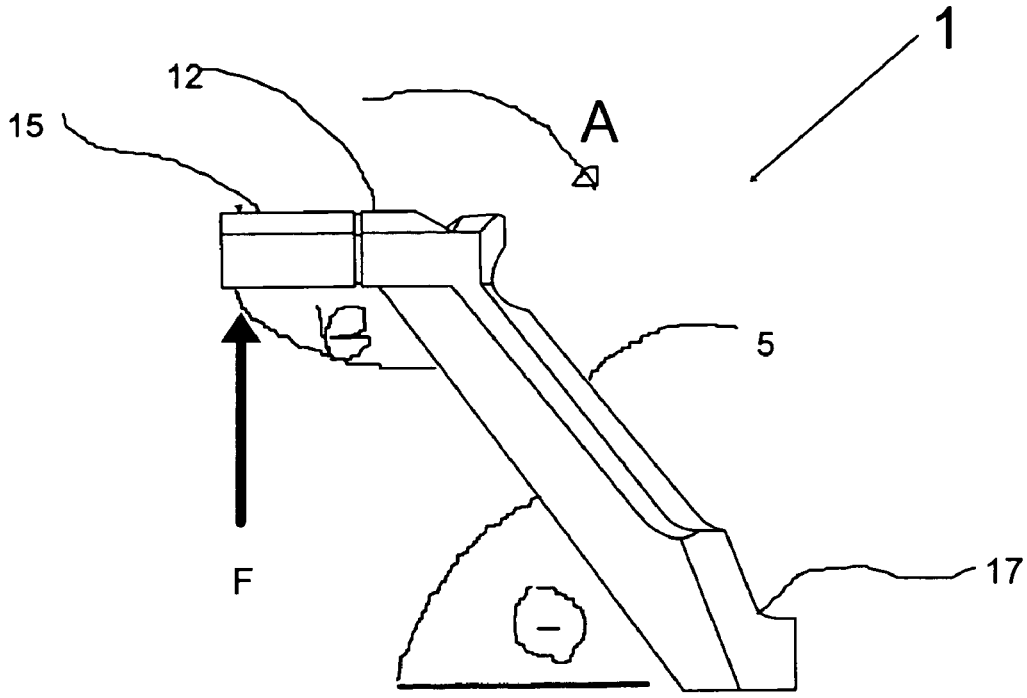
FIG. 1 is a side view of a prong in accordance with the invention.
Figure 2:
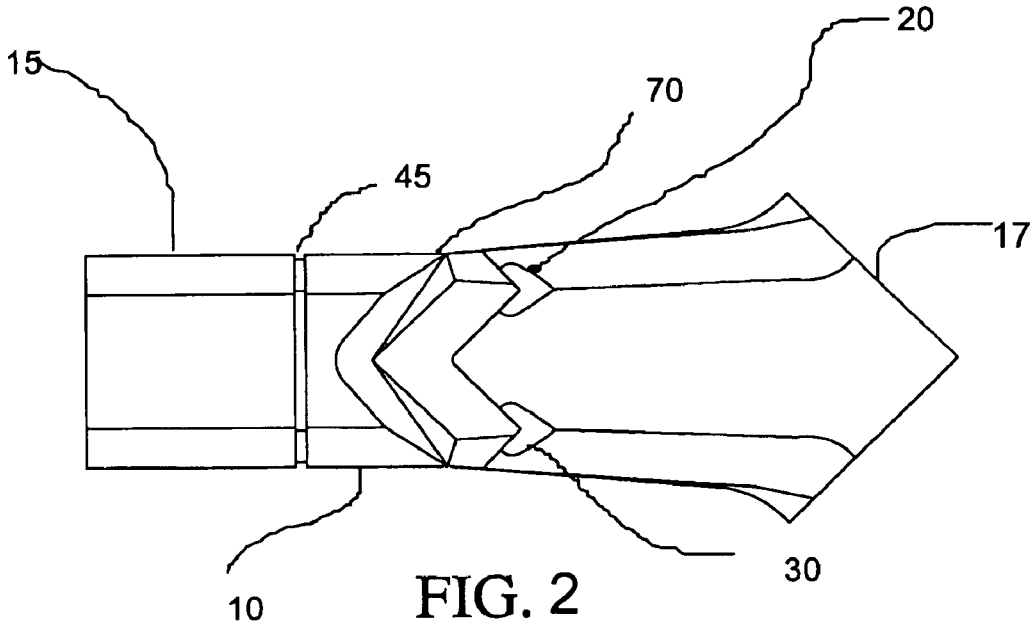
FIG. 2 is a top view of the prong of FIG. 1.
Figure 3:
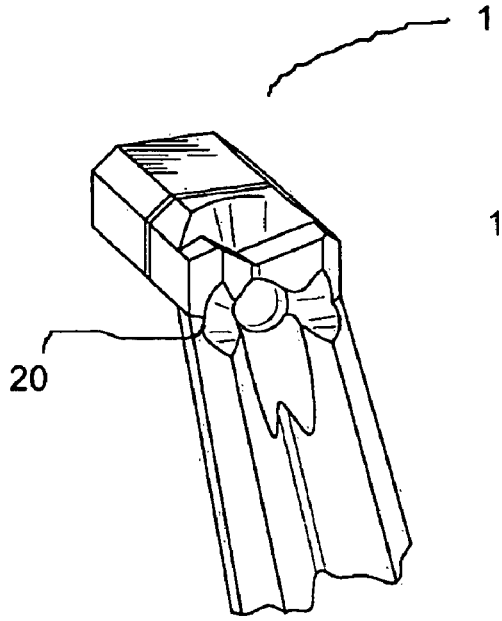
FIG. 3 is a front perspective view of the prong of FIG. 1.
Figure 4:
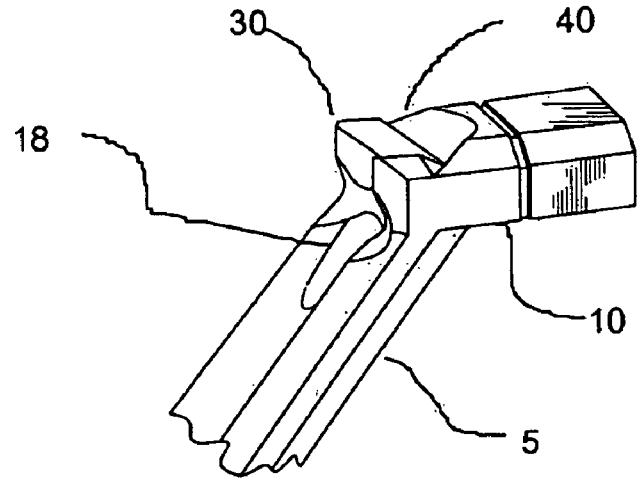
FIG. 4 is a side perspective view of the prong of FIG. 1.
Figure 7:
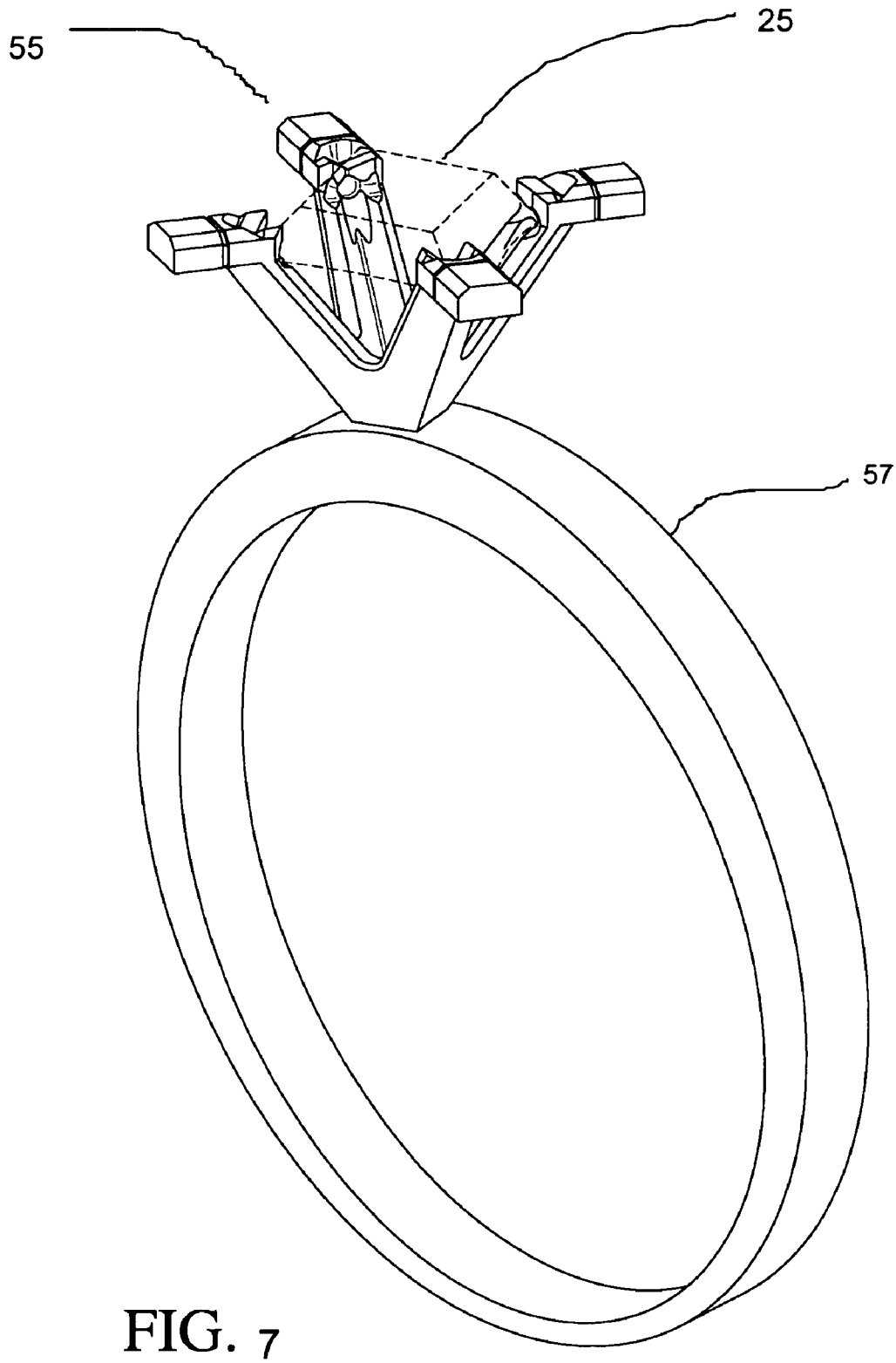
FIG. 7 is a perspective view of a jewelry setting that employs the prongs of FIG. 1.

As shown in FIGS. 1, 2 and 7, prong 1 includes riser section 5, engagement section 10, lever section 15 and base section 17. Engagement section 10 is integral with lever section 15. Riser section 5, as shown in FIGS. 3, 4 and 7, includes groove 18 and indents 20 for receiving an object such as gemstone 25. Indents 20 may have a depth of up to about 15% of the thickness of riser section 5 and may extend onto engagement section 10. Groove 18 may extend over a portion of riser section 5 or the entire length of riser section 5. Indents 20 may be configured to accept a variety of objects such as gemstones. These configurations may vary over a wide range from angular to curve. Indents 20 may extend to engagement section 10.

Riser member 5, as shown in FIG. 1, has an upward slope of angle Θ to the horizontal. Angle Θ may vary from about 5° to about 85°, preferably about 35° to about 65°, most preferably about 45°. Engaging section 10 preferably is oriented to riser section 5 at angle β=180°−Θ as shown in FIG. 1. Engaging section 10, however, may be oriented to riser section 5 at an angle β of other than 180°−Θ such as about 130°−Θ° to about 230°−Θ°. Lever member 15 as shown in FIG. 1 is in linear alignment with engagement section 10. Lever member 15, however, may be oriented to engagement section 10 at an angle other than in linear alignment with section 10.

Figure 5:
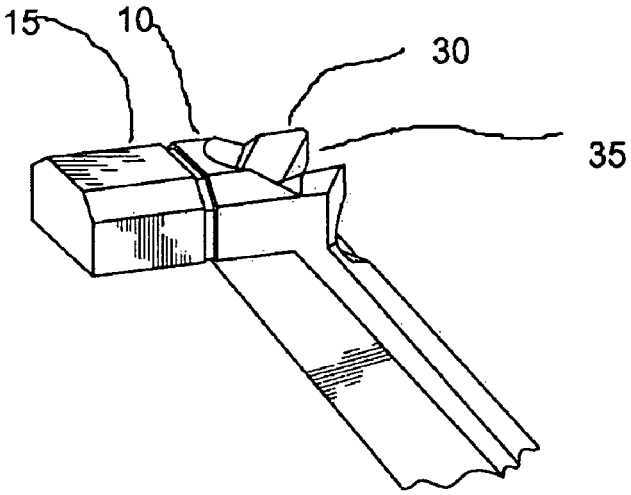
FIG. 5 is a side perspective view of the prong of FIG. 1 from the rear of the prong.
Figure 6:
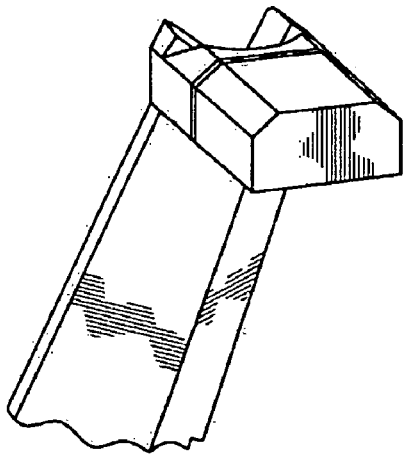
FIG. 6 top perspective view of the prong of FIG. 1 from the rear of the prong.

Riser member 5 may have a variety of cross-sectional profiles. For example, the width of riser section 5 may be constant throughout its length or may taper. The thickness of riser section 5 also may be constant throughout its length or may taper. Engaging section 10, as shown in FIGS. 5 and 7, includes tines 30 which diverge from each other to form V-notch 35. Tines 30 slope downward toward the rear of engagement section 10 at an angle of about 1° to about 89°, preferably about 5° to about 35°, more preferably about 5° to about 15° to the horizontal. The angular width of V-notch 35 may vary to accept a wide range of objects such as gemstones 25. Typically, V-notch 35 may have an angular width of about 1° to about 179°.

Engagement section 10 typically is shaped to conform to the geometry of the contact surfaces of gemstone 25. In one aspect, engagement section 10 includes V notch 35 formed by tines 30 that conforms to the geometry of the contact surfaces of gemstone 25.

Applying a force F to lever section 15 such as shown in FIG. 1 causes rotation of engagement section 10 of a prong 1 relative to indent 20. Typically, the extent of this rotation is about 15°. Force is continued to be applied to lever section 15 to cause engagement section 10 to rotate in the general direction of arrow A shown in FIG. 1 until tines 30 make firm contact with stone 25 in jewelry setting 55.

Lever member 15 and engagement section 10 may have the same or different configurations. Possible configurations include but are not limited to cylindrical, trapezoidal, regular polygonal such as a cubical, rectangular, pentagonal, hexagonal and the like, preferably rectangular. The length, width and depth of lever section 15 may vary over a wide range. Typically, the length of lever section 15 is about 50% to about 150% of the length of engagement section 10, the width of lever section 15 is about 100% to about 150% of the width of engagement section 10, and the thickness of lever section 15 is about 75% to about 150% of the thickness of engagement section 10. Lever section 15 may be integral with engagement section 10 as a unitary construction as shown in FIGS. 1-6. In this aspect, separation groove 45, as shown in FIG. 1, is provided between engagement section 10 and lever section 15.

Riser section 5, engagement section 10 and lever section 15 may be made from the same or different materials. Materials which may be used to form each of riser section 5, engagement section 10 and lever section 15 include but are not limited to Au, Ag, Pt, Pd, Cu, Fe or alloys thereof, as well as organic plastics such as polyethylene, polypropylene, polybutylene, and mixtures thereof.

Prongs 1 may be made by various known methods such as injection molding, casting and machining. As an example, prong 1 having riser section 5, engagement section 10 and lever section 15 and separation groove 45 may be formed as an integral construction by casting. Separation groove 45 also may be formed by machining.

As shown in FIG. 7, a plurality of prongs 1 may be joined at base section 17 to form jewelry setting 55 on a ring such as ring 57. Setting 55 shown in FIG. 1 includes an assembly of 4 prongs. Setting 55, however, may include any number of prongs 1. Typically, setting 55 includes 2, 3, 4, 6 or and 8 prongs. Setting 55 may be made by a variety of well known methods such as casting, brazing and the like.

When setting an object such as gemstone 25 in jewelry setting 55 that employs prongs 1, a gemstone 25 such as but not limited to square cut gemstones, marquise cut gemstones, pear cut gemstones, triangle cut gemstones, rectangle cut gemstones and heart cut gemstones first is positioned on indents 20 and in groove 18 of prongs 1. Thereafter, force is applied manually or by a griping tool such as pliers to lever section 15 of prong 1 such as in the direction of arrow F. This force causes yielding at indent 20 as engagement section 10 rotates in the direction of arrow A. Application of force also causes engagement section 10 that includes V notch 35 formed by tines 30 that conform to the geometry of the contact surfaces of gemstone 25 to engage gemstone 25. Thereafter, continued application of force to lever section 15 may cause lever section 15 to break away from engagement section 10 such as at separation groove 45. Alternatively, lever section 15 may be cut from engagement section 10 at separation groove 45. This procedure is repeated with each prong 1 to secure gemstone 25 in setting 55. Any portions of lever sections 15 which remain after having secured prongs 1 to gemstone 25 may be removed such as by machining, grinding, snipping or filing.

The invention claimed is:

1. A prong comprising a riser section, an engagement section, a lever section and a base section wherein the engagement section is integral with the lever section and the riser section and wherein the riser section is integral with the base section, the riser section having a groove extending over a portion of the length of the riser section and a plurality of indents on the riser section for receiving an object thereon wherein the indents extend onto the engagement section.

2. The prong of claim 1 wherein the groove extends over the entire length of riser section.

3. The prong of claim wherein the engagement section is oriented to the riser section at an angle β of about 130°−Θ° to about 230°−Θ°.

4. The prong of claim 1 wherein the riser section has an upward slope of angle Θ to the horizontal, wherein the angle Θ is about 5° to about 85°.

5. The prong of claim 1 wherein the riser section has an upward slope of angle Θ to the horizontal, wherein the angle Θ is about 35° to about 65°.

6. The prong of claim 5 wherein the engagement section is oriented to the riser section at angle β where β=180°−Θ.

7. The prong of claim 1 wherein the riser section has an upward slope of angle Θ to the horizontal, wherein the angle Θ is about 45°.

8. The prong of claim 1 wherein the lever section is in linear alignment with engagement section.

9. The prong of claim 1 wherein the lever section is oriented to the engagement section at an angle other than in linear alignment with the engagement section.

10. The prong of claim 1 wherein the engagement section includes tines which diverge from each other to a form V-notch.

11. The prong of claim 10 wherein the tines slope downward toward the rear of the engagement section at an angle of about 1° to about 89° to the horizontal.

12. The prong of claim 10 wherein the tines slope downward toward the rear of the engagement section at an angle of about 5° to about 35° to the horizontal.

13. The prong of claim 10 wherein the tines slope downward toward the rear of the engagement section at an angle of about 5° to about 15° to the horizontal.

14. The prong of claim 10 wherein the angular width of the V-notch is about 1° to about 179°.

15. The prong of claim 1 wherein the lever section and the engagement section have the same or different configurations.

16. The prong of claim 1 wherein the lever section has a length that is about 50% to about 150% of the length of the engagement section.

17. The prong of claim 1 wherein the lever section has a width that is about 100% to about 150% of the width of the engagement section.

18. The prong of claim 1 wherein the lever section has a thickness that is about 75% to about 150% of the thickness of the engagement section.

19. The prong of claim 1 further comprising a separating groove between the lever section and the engagement section.

20. A jewelry setting comprising a plurality of the prongs of claim 1.

21. The prong of claim 1 wherein the indents have a depth of up to about 15% of the thickness of the riser section.

22. A prong comprising a riser section, an engagement section, a lever section and a base section wherein the engagement section is integral with the lever section and the riser section and wherein the riser section is integral with the base section, wherein the lever section in linear alignment with the engagement section, the riser section having an upward slope of angle Θ of about 5° to about 85° to the horizontal and including a groove and a plurality of indents for receiving an object thereon, wherein the engagement section is oriented to the riser section at angle β of about 130° −Θ° to about 230°−Θ° to the horizontal, the engagement section having tines which diverge from each other to a form a V-notch that has an angular width of about 1° to about 179°, the tines sloping downwardly toward the rear of the engagement section at an angle of about 1° to about 89° to the horizontal, the lever section having a length of about 50% to about 150% of the length of the engagement section, a width of about 100% to about 150% of the width of the engagement section, and a thickness of about 75% to about 150% of the thickness of the engagement section, and wherein the lever section and the engagement section have the same or different configurations.

23. The prong of claim 22 wherein the riser section has an upward slope of angle Θ to the horizontal of about 35° to about 65°.

24. The prong of claim 22 wherein the riser section has an upward slope of angle Θ to the horizontal of about 45°.

25. The prong of claim 22 wherein the engagement section is oriented to the riser section at an angle Θ of about 180°−Θ.

26. The prong of claim 22 wherein the tines slope downward toward the rear of the engaging section at an angle of about 5° to about 35° to the horizontal.

27. The prong of claim 22 wherein the tines slope downward toward the rear of the engaging section at an angle of about 5° to about 15° to the horizontal.

28. The prong of claim 22 wherein the indents have a depth of up to about 15% of the thickness of the riser section.

* * * * *